United States Patent [19]

Clark et al.

[11] Patent Number: 4,589,341

[45] Date of Patent: May 20, 1986

[54] METHOD FOR EXPLOSIVE BLAST CONTROL USING EXPANDED FOAM

[75] Inventors: Charles J. Clark, Grand Prairie; Edward M. Bennett, Dallas, both of Tex.

[73] Assignee: Rockwood Systems Corporation, Lancaster, Tex.

[21] Appl. No.: 744,511

[22] Filed: Jun. 13, 1985

Related U.S. Application Data

[63] Continuation of Ser. No. 579,145, Feb. 10, 1984, abandoned.

[51] Int. Cl.[4] ..... F42D 5/00

[52] U.S. Cl. ..... 102/303; 252/3; 252/8.05

[58] Field of Search ..... 102/301, 302, 303; 252/2, 3, 8.05

[56] References Cited

U.S. PATENT DOCUMENTS

| | | | |
|---|---|---|---|
| 3,801,416 | 4/1974 | Gulbierz | 102/303 X |
| 3,945,319 | 3/1976 | Meagher | 102/303 |
| 4,074,629 | 2/1978 | Colgate | 102/313 |
| 4,198,454 | 4/1980 | Norton | 102/303 X |

*Primary Examiner*—Peter A. Nelson

*Attorney, Agent, or Firm*—Beehler, Pavitt, Siegemund, Jagger & Martella

[57] ABSTRACT

An improved method of blast suppression involves forming an expanded foam barrier maintained in position by a barrier element which, in a preferred form, is inflated and maintained inflated by the foam used to form the foam barrier. Various barrier structures and methods are disclosed for suppression of the blast wave.

19 Claims, No Drawings

METHOD FOR EXPLOSIVE BLAST CONTROL USING EXPANDED FOAM

This is a continuation, of application Ser. No. 579,145, filed Feb. 10, 1984, and now abandoned.

FIELD OF THE INVENTION

The present invention relates to the control of blasts due to bombs and explosive blast-producing devices and the like and more particularly to improved methods for controlling the same and especially the blast effects of such devices such that the same may be detonated in place, if desired, without causing significant damage to the surrounding area.

BACKGROUND OF THE INVENTION

Terrorist and extortion bombings have always been a problem for law enforcement officials, not only on a national scale but on an international scale as well. One of the problems heretofore faced has been the manner of disposing of a detected bomb or explosive or similar device. In the more common instances, the bomb or explosive device is placed in a public place or in a vehicle parked in a public place. Upon detection, the problem arises as to disposal of the device. In past years the procedure typically has been for trained bomb disposal personnel to attempt to disarm the device on the site. There are cases, however, in which the device may be quite sophisticated, or cases in which trained personnel are not available, or where the device may be remotely controlled.

More recently the potential for serious injury or death of those attempting to disarm the explosive device has led to the use of video camera carrying robots which are brought close to the explosive device to determine its size, construction or other information which may assist in the safe deactivation of the device. Unfortunately, however, not all law enforcement groups can afford the expense of robot units and there are situations in which robots may not be suitable for their intended function. For example, a robot may not be able to disarm a bomb in a briefcase left in the open. In such a case, the use of a robot normally involves picking up the device and carrying it to a disposal vehicle in which the device is transported to a remote bomb disposal site. Should the device detonate during transport by the robot to the disposal vehicle, there is a potential for significant injury to those in the area as well as significant property damage in the immediate area.

Perhaps the largest single cause of bodily injury in detected explosive devices comes from blasts which take place as the law enforcement officials first on the scene attempt to disarm the bomb in order to protect the public and the surrounding property. There are instances in which the nature of the explosive device is such that it is not readily capable of being deactivated at the site, but where it is attempted to disarm the device in order to protect the surrounding property. In some cases, the procedure is to detonate the device on site by the use of a smaller explosive device used to set off the main charge of the bomb. The result is a blast which may cause significant property damage in the immediate area. In other cases, the smaller device is used in an attempt to deactivate the main explosive device, by destroying wires or disabling the detonation mechanism. The latter procedure, however, may result in detonation of the main device and a more powerful blast. Even if successful, the detonation of the smaller charge may cause damage to valuable property in the immediate vicinity. Timer controlled or remote controlled devices add still another complexity to deactivation of the explosive device, that is, the need to act both quickly and with precision.

Typically, the damage done by the explosion comes from two sources, the first being the compression wave of the blast and the second being the fireball which immediately follows the blast. The compression wave is usually a high amplitude, short duration compressive wave which moves radially outwardly in all directions from the source. The strength of the wave and its duration are a function of the power and amount of the explosives used in the device. The fireball is a result of combustion of the combustable materials in the immediate region of the blast and is almost immediate with the compressive wave. Since the fireball consumes the combustibles in the region of the device, the effect is a reduction in the pressure behind the compressive wave with the net effect that there is a high pressure overpressure by the compression wave followed almost immediately by a reduced pressure front. The fireball also operates to ignite the combustibles which are in the immediate vicinity. For example, in a bomb placed in a vehicle having fuel in the gas tank, the compressive wave may cause significant structural damage to the vehicle, including rupture of the fuel tank, if the explosive is powerful enough. The fireball may ignite the interior of the vehicle if there is combustible material present and may cause either a secondary explosion as the fuel detonates or a severe fire as the fuel ignites. The result is that the region around the vehicle is traversed by debris blown by the blast, followed by a secondary explosion or intense fire.

For relatively small devices, such as letter bombs and briefcase bombs it may be possible to use blast blankets placed over the device to inhibit the effects of the blast as the device is detonated on site. The difficulty with bomb blankets is that they are quite heavy, usually formed of flexible closely woven steel mesh and not easily transportable to the needed site. The weight of the blast blankets may be such as to require the use of a crane. Moreover, blast blankets are not usually available quickly. In the case of bombs placed in vehicles, the number of blast blankets needed to cover the entire vehicle may be more than is immediately available, even if there is available equipment to position the blanket.

It is also known that explosive materials are used in building clearance programs in which relatively large structures, sometimes in populated areas, are felled by explosive charges placed at strategic locations in the main support structure and usually detonated in a timed sequence. While those engaged in this type of building demolition are highly trained and exercise an unusual amount of care, occasionally problems do arise. Typically, the charges are set and when detonated, the structure collapses as planned, but sometimes there is a substantial amount of window breakage in the structures in the surrounding area. Normally, the explosives used in these types of operations tend not to produce a fireball, but do produce a significant compression wave. Further, since the charges are usually set at ground level, there may be significant window damage at street level.

As is apparent, it would be desirable to provide a system which absorbs the compression wave so as to reduce the structural and bodily injury caused by the blast over-pressure while significantly reducing the fireball so as to reduce the damage caused by the combustion of ingitable or explosive material in the immediate vicinity of the blast. Particularly advantageous would be a system which is readily mobile, easy to use, effective for the purpose intended and which supresses the fireball as well as the effect of the compressive wave.

It is known in the prior art to use foams in fighting fires. Typically such foams are formed from water-soluble surfactants of the perfluorocarbon type which may be dispensed from a variety of different types of equipment, all well known in the art. One such typical material is known in the art as AFFF, see U.S. Pat. Nos. 3,258,423; 3,562,156 and 3,772,195, for example. Generically these materials are also known as FCS and HCS materials, e.g., fluorocarbon surfactants and hydrocarbon surfactants. Variations include those AFFF compositions which include a fluoro-chemical synergist known as F-amide and an FCS called F-AMPS, see for example U.S. Pat. Nos. 4,090,967 and 4,014,926. These foam producing materials are known to produce high-expansion foams which are known to spread over the surface in order to suppress vaporization of gasoline, which is the principal reason these materials were developed. Other patents which disclose similar materials are U.S. Pat. No. 4,090,967, United Kingdom Pat. No. 1,230,980 of 1971 and No. 1,126,027 of 1968, and Canadian Pat. No. 842,252, for example.

Foams from the above and other equivalent materials tend to be of small envelope or bubble size and flowable, the latter being one of the desirable qualities for use in fighting fires. Moreover, the foams may be formed relatively easily at the site of application by any number of different devices, all well known in the art. Portable units of various sizes as well as truck mounted units are commercially available for forming and dispensing various amounts of foamed material. For example, units are available which dispense from 2,000 to 15,000 or more cubic feet of foam per minute. Dispensing units include water reaction motors, electrically powered units, turbine units, compressed gas driven units and the like. Some of the dispensing equipment includes a tubular member which may be from two feet to ten feet in diameter, connected to the foam generator, and used to control the direction of foam discharge. The foam is discharged from the open end of the tubular member remote from the foam generator. The result is that an enormous amount of foam may be quickly dispensed from a relatively small unit in a relatively short time using a relatively small amount of water and foaming agent. Since the foam includes a surfactant, it tends to flow easily and spread quickly over the contact surfaces which it readily wets. Such foams may also be dispensed from high velocity nozzles and projected a relatively long distance and with sufficient accuracy to reach a designated target area.

Typically, the foams above described are sometimes referred to as expanded foams, having an expansion ratio of 50 to 1 to 1000 to 1. These types of foams do not have sufficient strength to remain in a three-dimensional shape, for example, a mound, for any significant length of time. Where the foam is dispensed from a tubular member, customarily referred to as a chute, the chute may be of a length of one hundred feet or more, with the foam being dispensed from the open end of the chute remote from the generator. Generators are known which have an output or discharge opening which may vary from one square foot to as much as twenty-five or more square feet.

The foams described, dispensed by known equipment and techniques, tend to have a relatively long life since collapse of the foam is due principally to evaporation of the water component of the foam. Thus in the absence of heat or flame, the foam tends to remain fairly stable for a relatively long period. However, it is also true that the foam tends to spread laterally rather quickly since this is one of the desirable features in its use as a fire-fighting material.

It is believed to be known in the prior art that fire fighting foams do exhibit blast suppression qualities. Even though known, there appears to have been little practical use of foams as a blast suppression medium apparently because of the inability to deliver the foam to the desired location and to maintain the foam in the immediate region of the explosive device. In other words, there does not exist in the prior art a methodology for containing the foam in the desired location, nor was it apparently recognized that the key to the successful use of foams as a blast suppression medium was dependent upon confining the foam. As near as can be determined, little use has been made in open areas, such as streets, large rooms and the like, of foams as a blast suppressor because it may not have been recognized that the effectiveness of the foam as a blast suppressor could be significantly increased by confining the foam.

SUMMARY OF THE INVENTION

In accordance with the present invention, an improved blast suppression method is provided through the use of foams heretofore used in fire fighting and wherein the formed foam is confined in such a way as to control the continued propagation of the blast wave, thereby absorbing the compression wave in all radial directions or selectively absorbing the blast wave so that its continued propagation in any given direction is suppressed.

The principal advantage of the present invention is that the explosive device may be detonated on site with a marked reduction in the destructive effect of the compression wave, and virtually complete confinement of the fireball (if the explosive is the type that tends to generate one) and any subsequent fire or secondary explosion. Since many terrorist and extortion bombs are placed in open areas or in large rooms, or in the case of building demolition, involves the use and detonation of high explosives in open areas, an important aspect of the method of the present invention relates to the confinement of the foam such that a barrier may be provided, relatively easily and effectively, to contain the compressive wave so that continued propagation in undesired directions is either controlled or substantially eliminated. Various methods may be used to create the barrier, which may be of various shapes and sizes depending upon the nature of the control desired.

Where total confinement is desired, the barrier may be of a size and shape which completely surrounds the device (if in a vehicle, fully surrounding the vehicle), and of a vertical height sufficient to contain a foam barrier which fully encloses the device in all directions above ground. The actual dimensions of the foam barrier, in this case, are preferably such that there is sufficient volume of foam maintained in place to suppress the compression wave which emanates from the blast. The rate of decreased of the intensity of the overpressure of the compression wave for various amounts and types of explosives is known in the art, and thus the dimension of the containment structure and the foam barrier within the containment structure may be ascertained to bring about the desired degree of suppression. For example, the suppression effect of the foam is related to its expansion ratio; the higher the expansion ratio, the less dense the foam, and thus more radial thickness is needed for a given weight of explosive. More particularly, the radial dimension of the foam, as measured radially outwardly in all directions above the ground from the explosive device is related to K times the weight of C4 plastic explosive to the $\frac{1}{3}$ power. K is a constant which varies with the expansion ratio of the foam. The higher the expansion ratio of the foam, the greater the amount of foam which is needed. The weight of C4 is normally approximated based on the type and weight of the explosive and is expressed as an approximate equivalent weight of C4. For example, 5.3 ounces of C4 is the equivalent of about one stick of dynamite.

In part, the size, geometry and placement of the confinement barrier and the contained foam barrier are a function of the type of protection needed. For example, at overpressures of 4 or more psi, as measured at the structure, an explosive blast may produce serious structural damage depending upon the nature of the construction of the structure, e.g., wood versus reinforced concrete, for example. At overpressures of $\frac{1}{2}$ to 1 psi, as measured at the structure, the result is usually window and glass breakage. In building demolition, which usually involves precisely placed shaped charges of known explosives and of known weights and power, the confinement barrier and the foam dimensions may be configured to prevent propagation of overpressures which cause glass breakage. In the case of bombs, the situation may be entirely different and the prevention of structural damage may be all that is desired, or all that can be achieved, because of the nature of the device and its location.

One of the significant advantages of the present invention is that it may be practiced with equipment and materials now generally available, for example, from Rockwood Systems Corporation.

In a preferred form of the present invention, the confinement barrier is formed by one or more chutes now used to dispense fire fighting foam, wherein the chutes are modified such that the delivery end is sealed. The chute may, for example, be lightweight plastic or fabric or any other suitable material capable of acting as a conduit for the foam. One or more apertures are formed along the length of the chute and may be oriented to point at different elevations, but preferably located to dispense the foam in a given, controlled direction once the chute is properly positioned, as will be described. In one form, the chute is fully collapsible, i.e., it is not self-supporting, for ease of handling, storage and transporting. Other chute structures may be used, as will be described. At the site, the chute is positioned a distance from the bomb location and preferably in an arrangement which fully surrounds the device to be detonated. For example, the chute may form a circle with the bomb located at the center of the circle. The chute is oriented such that once inflated as will be described, the openings are pointed in the direction of the device. One or more chutes or lengths of chute may be used, as needed to form the circle.

One or more foam generators may be attached to the chutes and started, filling the chutes with foam and expanding the chutes to form a foam-filled containment barrier. This procedure, in effect, erects a barrier which fully surrounds the device and extends vertically above the ground. The vertical height of the barrier may vary, as will be described. Once the barrier is erected, the foam from the generator or generators exits through the directional openings in the chute toward the device. The generator or generators are kept on until the entire region within the foam-filled barrier is filled with foam to a height at least equal to the vertical height of the foam-filled chute barrier. During the filling of the chutes, some of the water associated with the foam within the chute separates and collects at the bottom of the chute, acting as a weight to keep the chute in place.

After the entire volume within the foam-filled containment barrier is filled with foam, the area around the outside of the barrier may be cleared of people and the device detonated. The generators may be kept on or turned off depending upon the amount of foam needed. Since the foam is made up of a multiplicity of small bubbles, contained by the barrier system, an effective blast suppression enclosure is formed of compressible material which absorbs thc compression wave or a substantial portion of the compression wave. Clean up of the area is relatively simple and involves hosing the area with water to disperse or dissolve the foam.

Further details of this invention and a fuller understanding of the various ways in which it may be practiced may be better understood with reference to the following disclosure in which various forms of the invention are disclosed.

DETAILED DESCRIPTION OF THE INVENTION

In accordance with a preferred form of the invention, high-expansion foam may be used for several different, but beneficial, purposes in the suppression of explosive blasts. One purpose is to absorb the blast wave, provided a suitable barrier is provided to contain the foam in a defined area and in a controlled shape. As will be described, the barrier may be provided in several different ways. Another purpose is to extinguish the fireball, if one is formed, thus reducing secondary fires and secondary explosions, if the conditions are right for the latter to occur. Again, effective fireball and secondary fire and explosion control depend upon the formation of an effective barrier. Still another purpose of the foam is to assist in the formation of a physical barrier which, in turn, forms a containment structure for the foam which surrounds the device and which forms the principal medium for blast suppression.

The foam itself is a mass of uniform bubbles made from a water-detergent solution in which one part of the water-detergent solution may be expanded to from 50 to 1000 parts of expanded foam. The water-detergent solution may be of any of the materials previously mentioned and generally involves between 1% and 6% or more of detergent. The concentrate may be, for example, a synthetic base foam concentrate reinforced with protein additives and is used in the ratio of 1 to 3 parts by volume for each 100 parts of water by volume to form the foam. Other materials and other ratios may be used as is known in the foam art. A typical material is one known as JET-X, available from Rockwood Systems Corporation. Such a material, at an expansion of 600 to 1 contains about 75 gallons of water per 6,000 cubic feet of foam. These foams are also considered to be benign in the sense that full immersion for 60 minutes or so causes no harmful effects. Yet, care should be taken since there is a total loss of orientation when immersed in foam due to the inability to see or hear.

Foam generators are available which are capable of producing between 1,250 and 22,000 cubic feet of foam per minute. The expansion ratios of the foams used in such generators may vary from 135 to 1 to 1000 to 1, using water at a rate of between 37 gallons per minute at a pressure of 75 psi to as high as 165 gallons per minute at a pressure of about 100 psi. The weight of the generators may be as light as 10 pounds to as heavy as 350 pounds or more, and may be portable, trailer mounted or truck mounted. These commercially available units may also be helicopter transported. Various types of generators are available such as water reaction powered units, air aspirated units and the like. The generators generally require air for the formation of foam and operate best with fresh air.

One aspect of the foam and generation of foam is the fact that it tends to flow. Thus, an important aspect of this invention is the control of the foam, to prevent flow usually relied upon in fire fighting applications, and in contrast to such applications, to control the foam so a foam mound may be formed of a desired shape and size and confined within a defined location to a vertical height desired for blast suppression.

In a preferred form of the invention, the foam itself is used to construct the foam containment barrier at the desired location. To this end, a chute member is used and preferably arranged so as to surround the explosive device to be detonated. "Explosive device" as used herein may in fact be more than one explosive charge, as for example in building demolition in which a series of charges are set off in a continuous controlled sequence, as will be described. In the case of an explosive device such as a bomb, the chute is preferably arranged in a circular pattern around the device, but spaced radially therefrom. It is understood, however, that there may be circumstances in which the containment barrier may be of different shapes and wherein the barrier may not itself extend completely around the device. For example, where a bomb is placed near a building or other structure, such as a wall or dense bushes, the building or other structure may in fact form part of the barrier, with the chute forming the remaining portion of the barrier. The chute barrier may be of various cross-sectional shapes such as circular, square, rectangular, triangular, or the like. The chute may be fabricated of a variety of different materials such as plastic, nylon mesh or reinforced plastics, each of which is preferably foldable and relatively lightweight and flexible for easy storage, transport, handling and the like. In this form of the method of the present invention, the chute is not self-supporting in the sense that it has a defined expanded or partly collapsed shape. The chute may be fabricated such that as laid out on the ground, for example, it has an arcuate shape, e.g., it forms part of a circle.

The chute may vary in length from 25 to 100 feet or more and may be of a vertical height, when expanded, of 25 feet or more. A triangular shape has the advantage of a decreasing cross section in the vertical direction and thus the weight of foam gradually decreases in the vertical direction. This, however, is a more difficult and more expensive shape to manufacture, especially if made of plastic material. Regardless of the cross-sectional shape of the chute, it is preferred that one end be sealed closed and that there be at least one opening formed in a sidewall and so arranged that as the chute is laid out or unfolded during use, as will be described, the opening is pointed in the general direction of the device and the region to be foamed. This opening is a foam discharge opening and the chute may have several such openings along its length, depending upon the length of the chute and its diameter. If there is more than one opening, they may be located to direct foam at different elevational angles relative to ground level. The chutes used to form the barrier need not be of the same shapes or vertical heights. For example, if a bomb is located on a relatively steep street, it may be desirable to use a barrier on the lower side of the street which is of a vertical height greater than the barrier on the high side of the street since the high side of the street above the bomb may absorb some of the blast, and the angle of the street acts to direct the blast more in the direction of the lower side of the street. Under these circumstances, a greater amount of foam on the lower side of the street may be needed for effective blast suppression. It is also more difficult to contain the foam on the low side of the street because of the tendency of the foam to flow downhill.

The barrier members may be positioned in place relative to the device in any number of different ways, depending upon the particular situation. If the danger is severe robots may be used to position the deflated barriers. Lanyards attached to the deflated barrier chutes may be projected across the area and used to position the chutes. The chutes may be placed by helicopters. Regardless of the technique used to position the chutes, they should be located in such a manner as to provide the desired suppression when expanded and when the area is filled with foam. It is possible for example to position one or more foam generators at various points with the chutes, in rolled up form, attached to the foam generator. As foam is generated and propelled down the chute, it unrolls and fills with foam, with the foam being dispensed toward the device through the foam exit apertures. The chutes may be laid out on the surface in the shape desired and at the proper distance from the device. Thereafter, the foam generators may be attached and the chutes inflated with foam, the foam again being directed towards the device through the exit apertures.

It is also possible to use foam generators of different outputs for different purposes. For example, the chute barriers may be filled and maintained filled with generators of moderate capacity, while the region to be foamed is filled by a generator of greater output. In this case, the foam may be dispensed by a large duct arranged to dispense the foam over or through a passage provided in the chute barrier. When filled, the chute barrier is moved back into position to complete the containment barrier. Once the containment barrier, kept inflated by foam, is in place and the region surrounded by the barrier is filled with foam, the device may be detonated. The compression wave is absorbed by the foam on the inside of the barrier, which acts as an attenuator to suppress the wave such that the overpressures travelling beyond the foamed enclosure are significantly reduced. It is, of course, preferred in accordance with the present invention to attenuate the compression wave to the extent that the overpressures at the structures surrounding the site are kept below ½ psi.

In some instances, due to the size and/or potential power of the explosive device, it is not reasonably possible to achieve such marked reduction in the overpressure in all directions from the site of the device. In such instances, the best course of action is to attempt to attenuate the blast wave in all directions along the ground and for a reasonable vertical distance above ground, and at the same time focus the shock wave in a generally upward or vertical direction. This is possible in accordance with the present invention by spacing the chute barriers at the appropriate radial distance from the device and of the proper height, as described. The enclosure is filled with foam, as previously described. Even though the depth of the foam may not be sufficient to substantially attenuate the generated shock wave in a vertical direction, there may be substantially complete attenuation at ground level and for a height approximating the height of the containment barrier. In other words, since the dimension of the foam is sufficient in a lateral dimension to achieve substantial lateral attenuation, but insufficient to achieve the same effect vertically above the device, there is a non-uniform attenuation of the shock wave. Thus, there is maximum attenuation at the outer peripheral edge of the foam in a lateral plane at the level below the foam, which attenuation tends to decrease progressively towards the point at the top of the foam immediately above the device. The reduction in attenuation, however, is non-linear, with the result that the blast wave is focussed upwardly in a generally vertical direction with markedly reduced vertical component. In certain cases this may be an entirely acceptable situation, especially where a device is in an open area surrounded by tall buildings with large glass windows at ground level. Depending upon the depth of foam which the barrier contains, overpressures of less than ½ psi at ground level may be quite acceptable, even though the overpressures may gradually increase vertically at the structure interface for some limited vertical distance. For example, if the barrier and foam height at the periphery of the barrier is 25 feet, overpressures of the structure interface up to a vertical distance of 25 feet may be less than ½ psi, even though the overpressure for a region above 25 feet may increase somewhat. Since the distance from the bomb position as measured vertically to the structure interface increases as a function of the hypotenuse of a right triangle, the linear distance to the top of the foam blanket may decrease, but the distance from the bomb site to the structure interface increases. Thus, the reduction in the blast wave intensity as it travels in air, though not as great a reduction as achieved by foam suppression, is nonetheless reduced, even though the wave travels through a lesser dimension of foam in the region of the foam blanket immediately above the device.

Thus, there is maximum attenuation at ground level (zero elevation) in all azimuthal directions for a given depth of foam. At 90 degrees elevation, there is minimal attenuation because of the smaller dimension of the foam blanket. At a given elevation, the attenuation is the same in all azimuth directions, assuming the same linear dimension of foam is present. The total effect is that the blast wave is, in effect, focussed vertically where little damage may occur, provided there are no structures vertically above the device.

In accordance with the present invention, containment barriers may be configured specifically to focus the blast wave in a vertical direction. For example, an inner barrier may be formed of one vertical dimension with an outer barrier of a greater vertical dimension spaced from the inner barrier, e.g., the inner barrier is 10 feet high while the outer barrier is 25 feet high. The entire region within the inner and outer barriers is filled with the foam. The result is a foam contained region in which the device is covered with foam to one height, extending laterally for a given radial distance from the device. The foam barrier from the inner containment device to the outer containment device gradually increases in vertical height. Such an arrangement may be used, for example, where the nature of the device, the site of the device, the available generators and the circumstances are such that it is not possible to erect a foam barrier of the optimum full height.

As is apparent to those knowledgable in explosive devices, the foam barrier may be constructed in a number of various ways and in a number of various configurations in order to achieve significant attenuation and suppression of the blast wave, as may be needed by the particular circumstances. In accordance with the present invention, and as described, the essential feature is to provide a foam barrier which is contained in order to suppress the blast wave by the foam, which to be effective for its purpose must be fixed in position to act as the effective suppression medium which it forms.

By way of example, any number of different devices may be used to construct the physical barrier for the foam. For example, it is possible to erect foam barriers from various forms of sheet material supported by any number of different means. For example, overlapping plastic sheets may be hung from the windows of structures to be protected so as to form a barrier curtain. The foam may then be dispensed from a high capacity generator capable of generating foam at the rate of 22,000 cubic feet per minute. Buildings and automobiles or vehicles may be used as the barrier or a portion thereof since the nature of the foam is such that it tends to build vertically whenever it encounters any form of obstruction to lateral flow. The larger generators are capable of producing an amazing volume of foam in a relatively short period of time, and the foam, in the absence of fire or heat, tends to be stable for a period of time sufficient to provide the suppression medium to absorb the blast wave.

According to the present invention, the containment barrier may be formed of plastic or other material supported in a vertical position for the desired height. It may, for example, be formed by sheets supported from vertically arranged support elements, such as poles or vertically supported guide stringers. Chutes, however, are preferred because water from the foam tends to separate from the foam and settle at the base of the chute, acting as a weight. The barrier may be fixed in place to the supporting surface in order to prevent movement, if necessary. Self-supporting hollow barrier elements may be used, especially where the dimensions of the barrier member are such that the foam lacks sufficient strength to keep the barrier inflated or in place. Barrier elements of various different types may be used to form a containment barrier structure. For example, plastic sheet strung from buildings may be used to form a portion of the barrier structure, while chute barrier elements or fence type elements may constitute the remainder or a portion of the remainder of the barrier structure. A plurality of barrier closures of the same or different heights may be used. Thus, by way of example, the inner barrier structure may be of a greater height than the outer barrier, in which case the outer barrier not only forms a suppression medium, but also forms a lateral support element for the inner barrier. Virtually any form of structure may be used as a barrier since the nature of the foam is such that it tends to build up when it encounters an obstruction to lateral flow.

As stated previously, another advantage of the use of confined foam as a blast suppression medium is the fact that the fireball is contained, thus containing secondary fires and tending to inhibit secondary explosions.

A series of tests was performed to establish the ability of the contained foam to act as a suppression medium. In one series, 5.3 ounces of C4 was placed in a four-door sedan and detonated. The doors blew open, as did the trunk and the hood, while the top was severely crowned upwardly. The windshield was blown forward about 200 feet and a large fireball was formed upon detonation, causing an interior fire which consumed the vehicle and spread to the adjacent area. The same style of vehicle, a four-door sedan, had the same amount and type of explosive positioned in approximately the same location in the vehicle. It was then completely filled with foam and the C4 charge was detonated. In this case there was no buckling of the hood, top or trunk door; the doors remained attached and there was no window damage and the windshield remained in place. Furthermore, the fireball was completely contained such that there was no interior fire and no secondary fire.

The test was repeated, again using a four-door sedan with 10.6 ounces of C4 positioned as in the previous two tests. The vehicle was filled with foam and the device detonated. In this case the damage amounted to a blow out of the rear side window; the doors, windshield, hood and trunk door remained in place and were not noticeably deformed. It is true that in each case there was interior blast damage, but the blast, in the foam filled vehicles, was contained.

In another series of tests, two four-door sedans with 20-gallon fuel tanks each had five gallons of gasoline placed in the tank. A charge of 5.3 ounces of C4 was positioned under the gas tank of each vehicle. One vehicle was surrounded by a barrier about five feet high and the space between the vehicle and the barrier filled with foam. The second vehicle was not surrounded by a barrier. Neither car was filled with foam. In the case of the barrier contained vehicle, no significant outer structural damage took place. In the non-barrier test, the trunk door blew upwardly. In neither case was there any effect from the fireball since the foam was of a sufficient height to cover the charge, but in the barrier test the car was completely covered by foam.

In still another series of tests, 5.3 ounces of C4 was placed at ground level within a barrier of five feet in diameter and five feet high. The barrier was filled with foam and the charge detonated. There was no damage to the barrier structure and the blast was fully contained. In a companion test, the same weight of C4 was suspended in a trash can, the latter being positioned inside a barrier five feet in diameter. In this case the peripheral area around the can was filled with foam such that there was a non-foamed region between the charge and the can wall. Upon detonation, the barrier was blown off its support structure. In these tests the barrier was a plastic material supported by vertical support elements arranged in a five-foot circle, the plastic sheet being about five feet high. This test demonstrated the desirability of having the foam as close to the device as possible for suppression purposes, and preferably in contact with the device.

In still another test, to establish that a barrier system could be used to direct the direction of the blast wave, two concentric barriers were arranged with an open space inside the inner barrier. A charge of 5.3 ounces of C4 was positioned at ground level in the center of the inner barrier and the annulus between the two barriers was filled with foam to a height of about five feet. When detonated, the blast effect was vertically upwardly, with no damage to the barrier structure. Ground debris was blown upwardly in a vertical direction and landed, in some instances, outside the outer region beyond the periphery of the outer barrier.

In the case of building demolition, the present invention may be used to prevent damage to the surrounding structures. Usually in building demolition, shaped charges are used, and set off in a timed sequence, such that the entire structure is felled with what amounts to one sequential but unitary blast. The charges are normally set in such as way that the debris falls inwardly. There are, however, variations. The problem is that the charges located along the outer periphery and those inwardly, even though shaped charges and located to sever major structural reinforced columns, there remains a blast vector which is generally horizontal. Since these charges are set at ground level, there may be some ground level damage to the surrounding structures in the form of glass destruction. The method of the present invention may be used to reduce such damage by providing a foam curtain around the outer periphery of the structure to be felled by explosives. Unlike terrorist or extortion bombs, which are intended to destroy property and life, the felling of structures by explosive demolition is controlled and known. Thus it is somewhat easier to fabricate a barrier structure which is effective for the intended purpose, especially since the size, strength, location and intended effect of the charges are known.

Accordingly, containment barriers may be used to suppress the blast effects known with some precision. Blast curtains may easily be fabricated, using chutes or blast curtains, located around the outer periphery of the structure and of a height sufficient to reduce substantially the potential for glass shattering. In a typical system, a double barrier system, as described may be used around the periphery of the structure to be felled in order to suppress the lateral blast effects generated around the structure during demolition. Chutes may be used as well as spaced curtains, foam filled not only to suppress the blast effects, but also to reduce the dust formed during felling. Any of the systems, as described, may be used. From the nature of the operation, however, one alternative is to suspend curtains from the structure to be felled, or to position the curtains from an independent support system, with the region between the curtains filled with foam. Depending upon the particular circumstances, a wide variety of barrier systems may be used. It is important, however, that the foam be contained to perform the function for which it is intended to be used.

It will become apparent from the foregoing description that a much improved method has been provided for the attenuation and suppression of blast effects in a significant number of circumstances. To those skilled in the art of foams and to those skilled in the art of explosives, it will become apparent that various modifications may be made, based on the foregoing description, without departing from the scope of the present invention, as set forth in the appended claims.

What is claimed is:

1. A method of suppressing the blast effects of an explosive device upon detonation of the same comprising the steps of:

forming a barrier which effectively encloses the explosive device;

said barrier being spaced a predetermined distance from said explosive device and being of a predetermined height;

said step of forming said barrier including positioning at least one tubular barrier element in spaced relation to said explosive device and filling said tubular barrier element with high expansion foam to fill said barrier element with said foam, said high expansion foam being characterized by the property of flow in all directions and lacking sufficient strength to form a self-supporting three dimensional shape, and generating a high expansion foam and directing said foam into the space between said explosive device and said barrier to provide a foam barrier which surrounds said explosive device and which is maintained in place by said barrier whereby upon detonation of said explosive device, the compression wave is suppressed by absorption thereof by the foam in its path.

2. The method as set forth in claim 1 wherein said explosive device is completely covered by said foam which extends a lateral distance greater than the vertical height above said explosive device.

3. The method as set forth in claim 2 wherein said tubular barrier element is collapsible and wherein said foam is used to inflate said tubular barrier element and to maintain the same inflated until said explosive device is detonated.

4. The method as set forth in claim 1 wherein said tubular barrier element is a self-supporting member of a predetermined geometrical cross-sectional shape.

5. The method as set forth in any one of claims 2, 3 and 4 wherein said tubular barrier element includes an opening between the ends thereof and wherein at least a portion of the foam within said tubular barrier element flows through said opening in order to fill at least a portion of the space between said explosive device and said barrier.

6. The method as set forth in claim 1 wherein at least a portion of said barrier is a structure in the vicinity of said explosive device and wherein the step of providing a barrier includes positioning at least one movable barrier element in position such that said structure and said barrier element cooperates to form a barrier enclosure effectively enclosing the explosive device on all sides.

7. The method as set forth in claim 1 wherein said barrier includes at least two barrier elements.

8. The method as set forth in claim 1 wherein at least a portion of said barrier is formed of sheet material supported in a vertical direction.

9. The method as set forth in claim 1 wherein said barrier is of essentially the same vertical height in all directions.

10. The method as set forth in claim 1 wherein said barrier includes portions of different vertical height as measured with reference to the location of said explosive device.

11. The method as set forth in claim 1 wherein said barrier includes separate barrier elements which form spaced enclosures with a space therebetween, and wherein the space between said barrier elements is filled with said foam.

12. The method as set forth in claim 11 wherein all of the space within said barrier elements is filled with foam.

13. The method as set forth in claim 1 wherein the vertical height of the foam and the radial dimension thereof is sufficient to reduce the overpressure of the blast wave to less than about 1 psi as measured at structures in the vicinity and which have a line of sight exposure to the site of the explosive device.

14. The method as set forth in claim 1 wherein the barrier is so positioned relative to the explosive device that the foam barrier extends laterally a distance sufficient to reduce the overpressure of the compression wave to less than about ½ to 1 psi as measured on the side of said barrier opposite the foam enclosing side thereof.

15. A method of suppression of the blast effects at ground level during the demolition of a structure by detonation of an explosive device, comprising the steps of:

forming a barrier which surrounds said structure, said barrier being located a predetermined distance from said structure and having a predetermined height, and generating a high expansion foam and filling the space formed by said barrier with said foam whereby upon detonation of said explosive device the shock wave is suppressed by said foam.

16. The method as set forth in claim 15 wherein said barrier includes spaced barrier elements one positioned inside of the other to form a containment structure surrounding said structure, and said foam filling said contained structure such that the foam is spaced from said structure.

17. A method of suppressing the blast effects of an explosive device upon detonation of the same comprising the steps of:

providing at least one tubular barrier member having an opening between the ends thereof;

positioning said tubular barrier member in spaced relation to said explosive device;

flowing high expansion foam into said tubular barrier member to form a foam filled barrier member, and flowing high expansion foam through said tubular member such that the foam enters the space between said tubular member and said explosive device to fill at least a portion of said space to provide a foam barrier capable of suppressing at least a portion of the compression wave upon detonation of said explosive device.

18. A method as set forth in claim 17 wherein said tubular member is collapsible and wherein said high expansion foam is used to inflate said tubular barrier member.

19. A method as set forth in claim 17 wherein a plurality of tubular members are positioned so as to completely surround said explosive device, and filling each such member with said foam to form a foam filled barrier enclosure.

* * * * *